United States Patent [19]

Williams, Jr.

[11] 4,255,473

[45] Mar. 10, 1981

[54] METERED FINISH

[75] Inventor: Louis B. Williams, Jr., Walnut Hill, Fla.

[73] Assignee: Monsanto Company, St. Louis, Mo.

[21] Appl. No.: 54,387

[22] Filed: Jul. 2, 1979

[51] Int. Cl.[3] ..... B05D 1/00

[52] U.S. Cl. ..... 427/445; 8/151.2; 8/158; 118/401; 118/411; 118/412; 118/420

[58] Field of Search ..... 427/445; 118/420, 411, 118/412, 401, DIG. 19; 8/151.2, 158

[56] References Cited

U.S. PATENT DOCUMENTS 3,827,397 8/1974 Hebberling et al. ..... 118/420

*Primary Examiner*—Ronald H. Smith
*Assistant Examiner*—Janyce A. Bell
*Attorney, Agent, or Firm*—Kelly O. Corley

[57] ABSTRACT

In application of metered finish to a high speed running yarn, the exit portion of the finish passageway is angled such that a positive atmospheric gauge pressure adjacent to the exit of said passageway is maintained.

9 Claims, 5 Drawing Figures

METERED FINISH

The invention relates to the art of metering finish onto a yarn running at high speed.

An essential part of spinning a man-made yarn is application to the yarn of a finish, which is a liquid composition for lubrication, reduction of static electricity, and other functions. Non-uniform application of the finish along the length of the yarn creates various processing problems in subsequent operations on the yarn, and causes defects in products made from the yarn. Finish has commonly been applied by contacting the running yarn with the periphery of a slowly rotating wheel, the lower portion of the wheel being immersed in the finish. This method gives somewhat erratic results.

More recently, attempts have been made to meter the finish to an applicator (commonly known as a "finish pin") in order to improve uniformity of finish application. However when yarn speeds are above 2500 meters per minute, erratic results are frequently obtained when using known commercially available applicators. Applicant has discovered that much of the difficulty arises because of the influence of pressure fluctuations caused by the turbulent, high speed air entrained with the rapidly moving yarn.

According to a principal aspect of the invention, there is provided in a process for applying finish to a yarn running at least 2500 meters per minute and wherein the finish is metered through a passageway just prior to application to the yarn, the improvement comprising maintaining a positive atmospheric gauge pressure adjacent to the exit of the passageway. This is preferably done by arranging that finish flowing through the passageway just prior to exiting from the passageway has a component of motion in opposition to motion of the yarn. This is most readily achieved when the axis of the passageway just prior to the exit of the passageway is within 45 degrees, preferably within 15 degrees, of being parallel with the axis of the yarn approaching the finish applicator.

According to another aspect of the invention, there is provided in a finish applicator wherein finish is metered through a passageway to a yarn running at least 2500 meters per minute, the improvement wherein finish flowing through the exit end of the passageway has a component of motion in opposition to motion of the yarn. Preferably, the exit end of the passageway is within 45 degrees, optimally within 15 degrees, of being parallel to the axis of the yarn approaching the applicator.

Other aspects will in part appear hereinafter and will in part be obvious from the following detailed disclosure taken in connection with the accompanying drawings, wherein.

Figure 1:
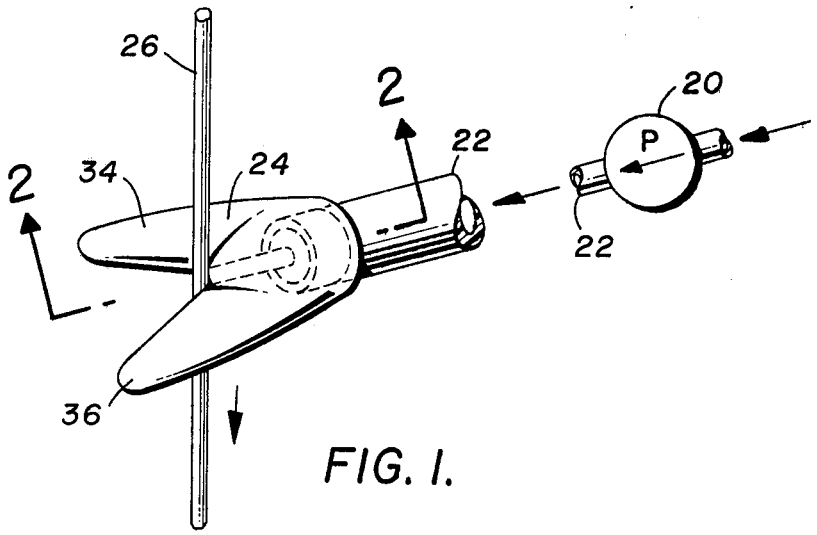
FIG. 1 is a schematic perspective view of a finish metering system.

FIG. 1 schematically shows the general metered finish system. As illustrated, finish is metered at a selected constant rate by metering pump 20 through line 22 to metering pin 24 for application to running yarn 26.

Figure 2:
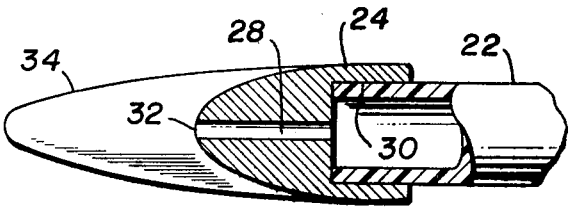
FIG. 2. (PRIOR ART)
FIG. 2 is a sectional view taken along line 2—2 in FIG. 1 showing a generalized prior art finish pin.
Figure 3:
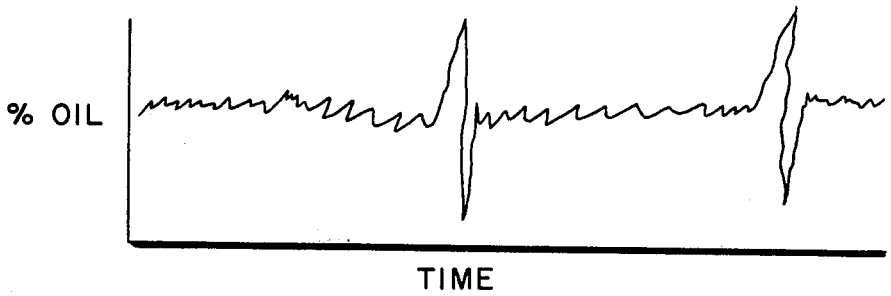
FIG. 3 is a generalized graph showing one type of observed concentration of finish applied on yarn with the FIG. 2 type of finish pin.

When finish pin 24 is constructed according to the prior art, as exemplified by FIG. 2, erratic results are frequently obtained, particularly when yarn 26 is moving at least 2500 meters per minute. In the FIG. 2 construction, a simple right circularly cylindrical fluid passageway 28 extends from the supply end 30 for receiving line 22 to its exit end 32, the latter lying at the bottom of a groove formed between two protruding fingers 34 and 36. Yarn 26 rides in the groove to receive the finish metered through passageway 28. Depending on the diameter of passageway 28, the rate at which pump 20 supplies finish, the speed of yarn 26 and the orientation of yarn 26 with respect to finish pin 24, the resulting concentration of finish on yarn 26 is frequently observed to be erratic rather than substantially constant as is desired. One such pattern is schematically shown in FIG. 3, which is a simplified or stylized representation of charts made using a denier monitoring instrument model M/7000R commercially available from Micro Sensors, Inc., together with head model 708 HC for this instrument from the same manufacturer. The output of this instrument responds not only to yarn denier but also to concentration of finish on yarn. The particular phenomena depicted in FIG. 3 is a normally reasonably constant finish level (fluctuations within a narrow range) followed first by an abrupt increase in finish level well outside the narrow range, then by a sharp decrease to an abnormally low level outside the normal range, then a return to the narrow range. A second such sequence is also shown. Other patterns of deviation from the normal narrow range may be generated, depending on the factors noted above.

It has been discovered that such undesirable deviations may be substantially reduced by inhibiting the variable influence of air entrained or travelling with yarn 26 upon finish in passageway 28. The entrained air is highly turbulent and produces fluctuating negative atmospheric gauge pressures at exit end 32 of passageway 28, displacing a quantity of finish before it would normally have left the passageway exit under the urging of pump 20. This would account for the observed abrupt increases in finish level (FIG. 3). Since such action would deplete the finish in exit end 32, a lower than normal quantity of finish would then be applied to yarn 26 until passageway 28 were again filled with finish by pump 20, thus accounting for the abnormally low levels of finish depicted in FIG. 3. However, regardless of the specific mechanism, maintaining a positive atmospheric gauge pressure adjacent to exit end 32 has been found to substantially reduce the undesired fluctuations in level of finish applied to yarn 26.

Figure 4:
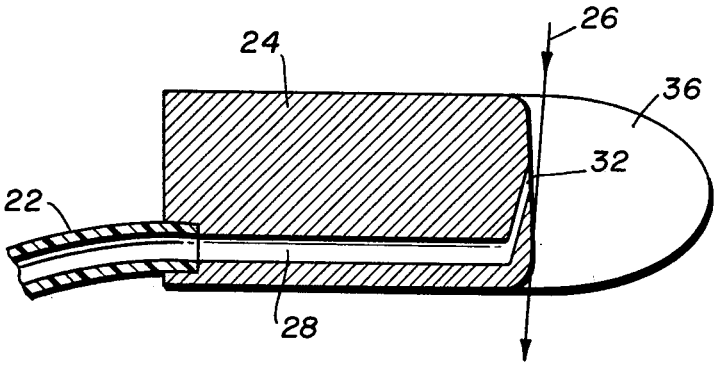
FIG. 4 is a sectional view (similar to FIG. 2) of the preferred embodiment of a finish pin according to the invention.

The preferred embodiment of the invention is shown in FIG. 4, wherein exit end 32 is angled upwardly along an axis nearly parallel to the axis of yarn 26. This gives finish flowing through exit end 32 a component of motion in opposition to motion of yarn 26. The downwardly rushing air entrained with yarn 26 accordingly maintains a positive atmospheric gauge pressure adjacent the exit of passageway 28. Negative atmospheric gauge pressure fluctuations are thus prevented from siphoning uncontrolled amounts of finish from passageway 28. Finish exiting from passageway 28 flows downwardly in the groove formed by the fingers prior to contacting yarn 26.

Figure 5:
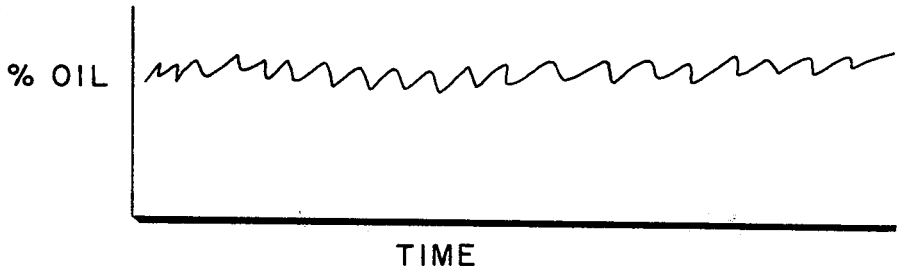
FIG. 5 is a generalized graph of concentration of finish applied on yarn with the FIG. 4 finish pin.

The improved results according to the invention may be seen in FIG. 5, wherein the abnormally high and low variations in finish level of FIG. 3 are substantially reduced or eliminated.

It is ordinarily easiest to maintain a positive atmospheric gauge pressure adjacent to exit end 32 when the axis of exit end 32 is within 45 degrees of being parallel to the axis of yarn 26 approaching pin 24, and constructions wherein the axes are within 15 degrees of parallelism are preferred.

What is claimed is:

1. In a process for applying finish to a yarn running at least 2500 meters per minute and wherein said finish is metered through a passageway just prior to application to said yarn, the improvement comprising maintaining a positive atmospheric gauge pressure adjacent to the exit of said passageway.

2. The process defined in claim 1, wherein finish flowing through said passageway just prior to exiting from said passageway has a component of motion in opposition to motion of said yarn.

3. The process defined in claim 2, wherein finish exiting from said passageway flows downwardly in a groove prior to contacting said yarn.

4. The process defined in claim 2, wherein the axis of said passageway just prior to the exit of said passageway is within 45 degrees of being parallel with the axis of said yarn approaching said finish applicator.

5. The process defined in claim 4, wherein said axis of said passageway is within 15 degrees of being parallel with said axis of said yarn.

6. In a finish applicator wherein finish is metered through a passageway to a yarn, the improvement wherein finish flowing through the exit end of said passageway has a component of motion in opposition to motion of said yarn.

7. The finish applicator defined in claim 4, wherein finish exiting from said passageway flows downwardly in a groove prior to contacting said yarn.

8. The finish applicator defined in claim 6, wherein the exit end of said passageway is within 45 degrees of being parallel to the axis of said yarn approaching said applicator.

9. The finish applicator defined in claim 8, wherein the exit end of said passageway is within 15 degrees of being parallel to the axis of said yarn approaching said applicator.

* * * * *